United States Patent [19]

Silver

[11] 4,298,196

[45] Nov. 3, 1981

[54] ROCKING TOY

[76] Inventor: Elizabeth J. Silver, 12172 Vivacite Walk, St. Louis, Mo. 63141

[21] Appl. No.: 37,865

[22] Filed: May 10, 1979

[51] Int. Cl.[3] ..... A63G 17/00

[52] U.S. Cl. ..... 272/52; 46/17; 46/26; 297/258

[58] Field of Search ..... 272/1 R, 1 D, 52, 52.5, 272/53.1, 53.2, 56, 1 C; 46/1 L, 157, 22, 17, 23, 15, 31, 26; 297/442, 258; 248/174

[56] References Cited

U.S. PATENT DOCUMENTS

| | | | |
|---|---|---|---|
| 1,519,207 | 12/1924 | Kay | 248/174 X |
| 2,487,654 | 11/1949 | Hoffman et al. | 46/26 |
| 2,721,080 | 10/1955 | Wischer | 272/1 D |
| 3,212,464 | 10/1965 | Steuer | 297/442 UX |
| 3,224,137 | 12/1965 | Wright et al. | 46/26 |
| 3,439,444 | 4/1965 | Smith | 46/1 L |
| 3,990,601 | 11/1976 | Joyce | 248/174 X |
| 4,120,493 | 10/1978 | Sommer | 272/52 |

FOREIGN PATENT DOCUMENTS

| | | | |
|---|---|---|---|
| 543145 | 7/1957 | Canada | 272/52 |
| 1186273 | 4/1970 | United Kingdom | 272/1 D |
| 1260127 | 1/1972 | United Kingdom | 272/53.2 |

*Primary Examiner*—Richard C. Pinkham
*Assistant Examiner*—Arnold W. Kramer
*Attorney, Agent, or Firm*—Lionel L. Lucchesi

[57] ABSTRACT

A rocking toy capable of being ridden and rocked which is assembled from a plurality of three-dimensional modules. Each of the modules is preferably formed from a pre-cut and pre-scored unitary piece of rigid sheet material, such as corrugated paperboard, which may be readily folded to form a three-dimensional module. The modules are interconnected in such manner as to form a rigid and sturdy rocking toy rockable on a rocking surface formed by the modules.

6 Claims, 13 Drawing Figures

ROCKING TOY

BACKGROUND OF THE INVENTION

This invention relates to a toy and more particularly to a rocking toy in the form of an abstract rocking horse or the like intended to ridden by a child which is assembled from a kit comprised of a plurality of pre-cut, pre-scored sheets of corrugated paperboard or other rigid sheet material. Each of the sheets is foldable to form a three-dimensional module and the modules are adapted to be interconnected when assembled so as to form a substantially rigid rocking toy.

Heretofore, rocking toys, such as hobby horses and the like, were conventionally made from wood or other material and involved a good deal of labor to fabricate and to assemble the toy. Also, an assembled conventional rocking horse consumed considerable volume for shipment. Still further, the expense of wood and other materials has made such rocking toys cost considerably more than they had previously cost.

Reference may be made to such prior U.S. Patents as Nos. 560,957, 650,675, 1,209,314, 2,551,071, 2,720,253, 2,755,087 and 2,844,188 for examples of prior art toys including rocking toys made of sheet material and shipped in knock-down form. In general, however, these prior rocking toys were either not intended to be ridden by a child, or if so intended, were constructed in such manner that only single plies of sheet were required to support the weight of the rider. However, when these single panels were constructed of paperboard, they were subject to being damaged.

SUMMARY OF THE INVENTION

Among the several objects and features of this invention may be noted the provision of a toy, such as a rocking toy, made from a plurality of unitary pieces of pre-cut and pre-scored sheets of corrugated paperboard material or the like which may be readily assembled into interlocking three-dimensional modules so as to constitute a substantially rigid structure for the toy capable of being sat on or ridden by a child or other person;

the provision of such a rocking toy which is made of easily formed, readily available, and inexpensive material;

the provision of such a rocking toy which may be readily fabricated, shipped and assembled; and the provision of such a rocking toy which is safe in use.

Briefly, a toy of this invention comprises a plurality of modules interconnected together, each of the modules being formed preferably of rigid sheet-like material, such as corrugated paperboard or the like. The toy includes a plurality of main body modules including a pair of end body modules and at least one intermediate body module between the end body modules. Each of the body modules has a pair of generally tubular legs arranged in back-to-back relation with the inner leg of the end body modules having an opening therethrough and with both of the legs of the intermediate body modules having respective openings therethrough. A plurality of generally C-shaped top connecting modules each having a pair of legs and a web interconnecting its legs. Each top connecting module is installed so that legs are inserted in adjacent openings of the body modules. A plurality of bottom connecting modules each having a pair of legs and a web interconnecting the legs is provided and each of the bottom connecting modules is inserted in adjacent openings of the body modules. A plurality of so-called side connecting modules are provided each having a main panel adapted to be disposed between the legs of one of the body modules, side panels overlying the sides of the legs of two adjacent body modules, and a pair of end panels adapted to be received between the legs of the next adjacent body module. The webs of the bottom connecting members form a bottom surface on which the toy may rock whereby, with the modules so assembled, the modules are securely interlocked with one another so as to form a substantially rigid toy capable of being ridden by a child sitting on the tops of the body modules.

Corresponding reference characters indicate corresponding parts throughout the several views of the drawings.

BRIEF DESCRIPTION OF THE DRAWINGS

FIG. 1 is a perspective view of an assembled rocking toy of this invention in the form of an abstract rocking horse or the like;

FIGS. 2–9 are flat patterns panels or of pieces of rigid sheet-like material, such as corrugated paperboard, which form a kit of this invention from which a rocking toy, such as shown in FIG. 1 may be assembled, the dotted lines indicating fold or score lines along which the panels may be folded so as to constitute three-dimensional modules for assembly into the rocking toy, with:

FIG. 2 illustrating a piece from which an end main body module may be formed;

FIG. 3 illustrating a piece from which a head module corresponding to the head of the rocking horse toy may be formed;

FIG. 4 illustrating a piece from which an intermediate main body module may be formed;

FIG. 5 illustrating a piece from which a side connecting module may be formed;

FIG. 6 illustrating a sheet from which a generally U-shaped top connecting module may be formed;

FIG. 7 illustrating a piece from which a tab may be formed for attachment of the head module to one of the end main body modules;

FIG. 8 illustrating a piece from which a generally U-shaped bottom connector module may be formed;

FIG. 9 illustrating a piece from which a cover module may be formed, this cover module constituting a seat for the toy;

Corresponding reference characters indicate corresponding parts throughout the several views of the drawings.

DESCRIPTION OF PREFERRED EMBODIMENTS

Figure 1:
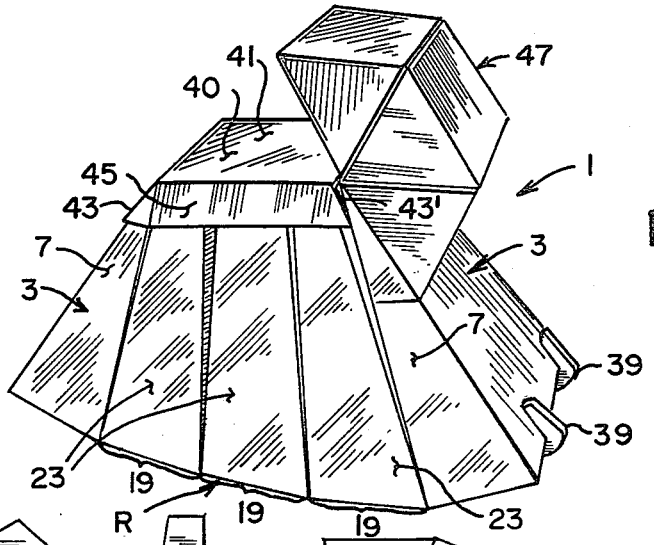
Figure 10:
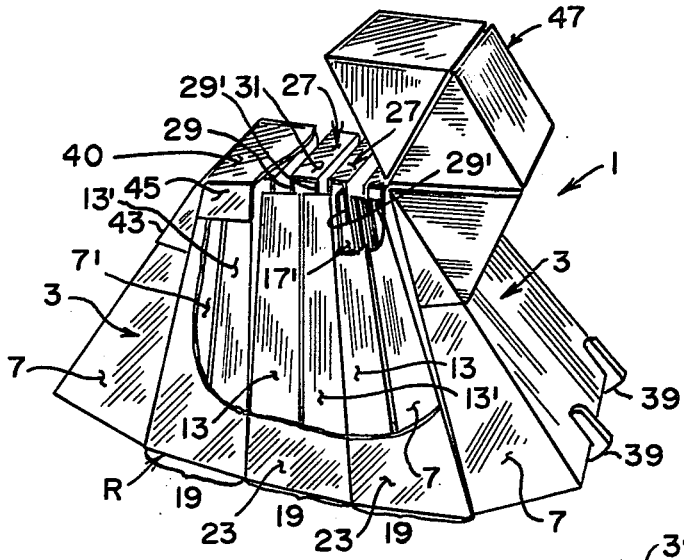
FIG. 10 is a perspective view similar to FIG. 1 with portions of the various modules broken away so as to illustrate the construction of the toy.

Referring now to the drawings, a rocking toy of this invention is indicated in its entirety at 1 in FIGS. 1 and 10. The rocking toy of this invention is shown to be comprised of a plurality of so-called three-dimensional modules interconnected together in such a manner as will be hereinafter disclosed with or without fasteners or adhesives so as to form a rigid toy capable of being ridden by a child. Each of the modules is formed preferably from a unitary piece or panel of substantially rigid sheet-like material, such as corrugated paperboard or the like. However, it will be understood that the pieces may be formed from a number of pieces of paperboard interconnected together such as by adhesive or tape so that the panel only need be folded for assembly of the module.

Figure 2:
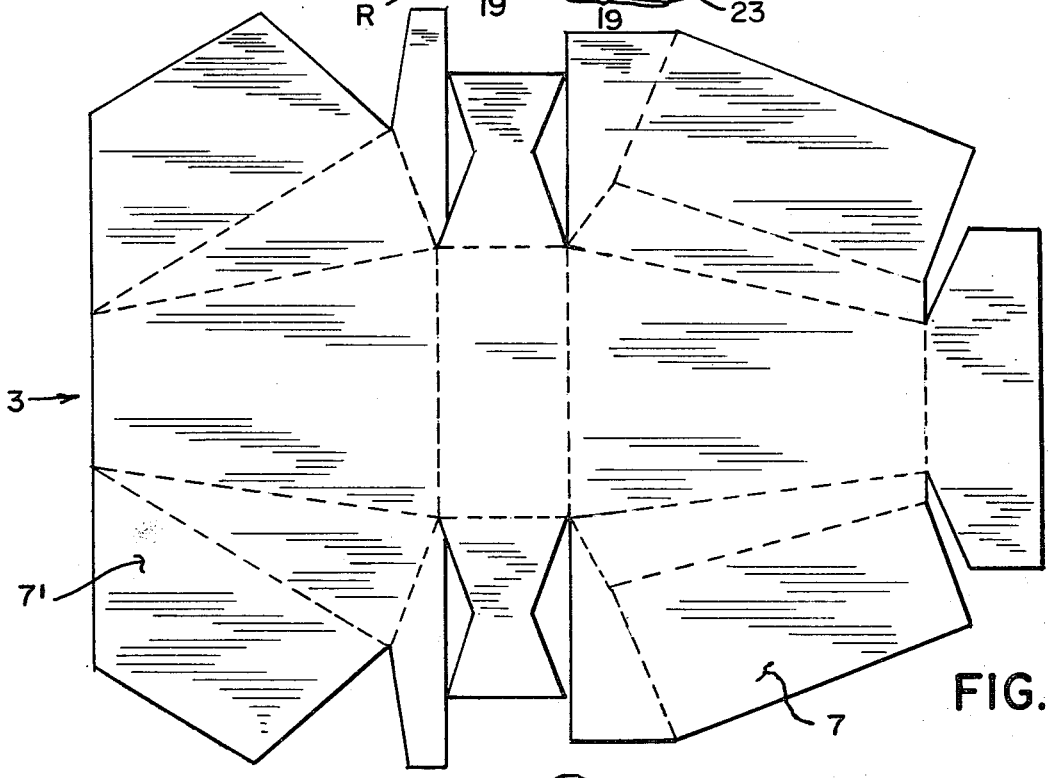
Figure 11:
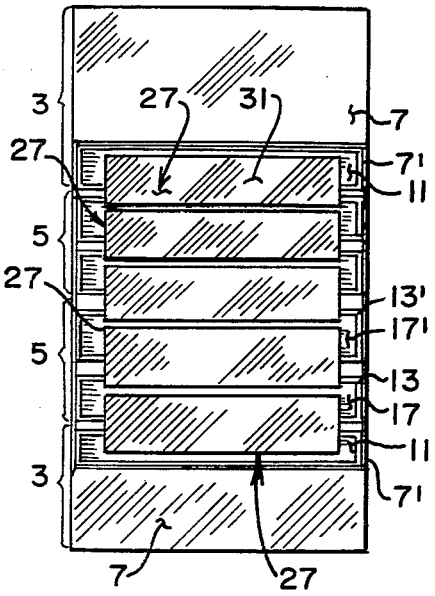
FIG. 11 is a top plan view of the toy with the cover or seat module and the head module removed.
Figure 13:
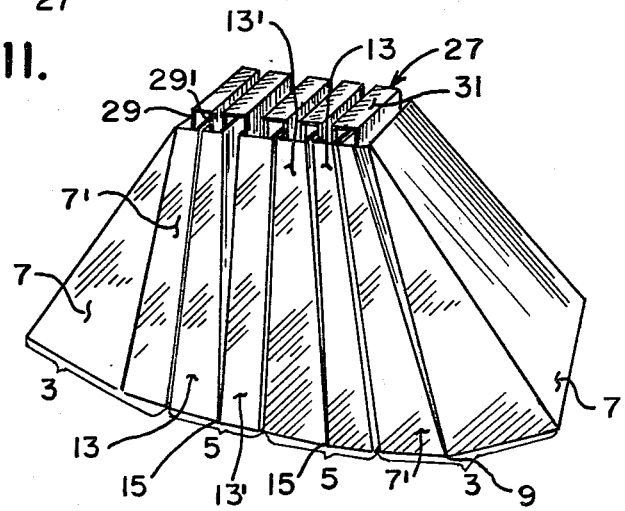
FIG. 13 is a perspective view of two end main body modules and two intermediate main body modules in their assembled position.

As best shown in FIG. 13, toy 1 is made of a plurality of main body modules including a pair of end main body modules, each of which is generally indicated at 3, and at least one (two are shown) of intermediate main body modules 5 disposed between the end body modules. The flat pattern of the piece of corrugated paperboard from which each end main body module 3 is formed is shown in FIG. 2. The end main body module, when formed, has a pair of back-to-back, upwardly projecting legs with the outer leg being indicated at 7 and with the inner leg being indicated at 7'. A web 9 (see FIG. 13) connects legs 7 and 7'. The outer leg 7 is shown to be closed at its top and the interior leg 7' is shown to have an opening 11 (see FIG. 11) at its top and extending heightwise therethrough. Legs 7 and 7' are of generally hollow construction and are of rectangular cross section, and leg 7' is open at both its top and at its bottom.

Figure 4:
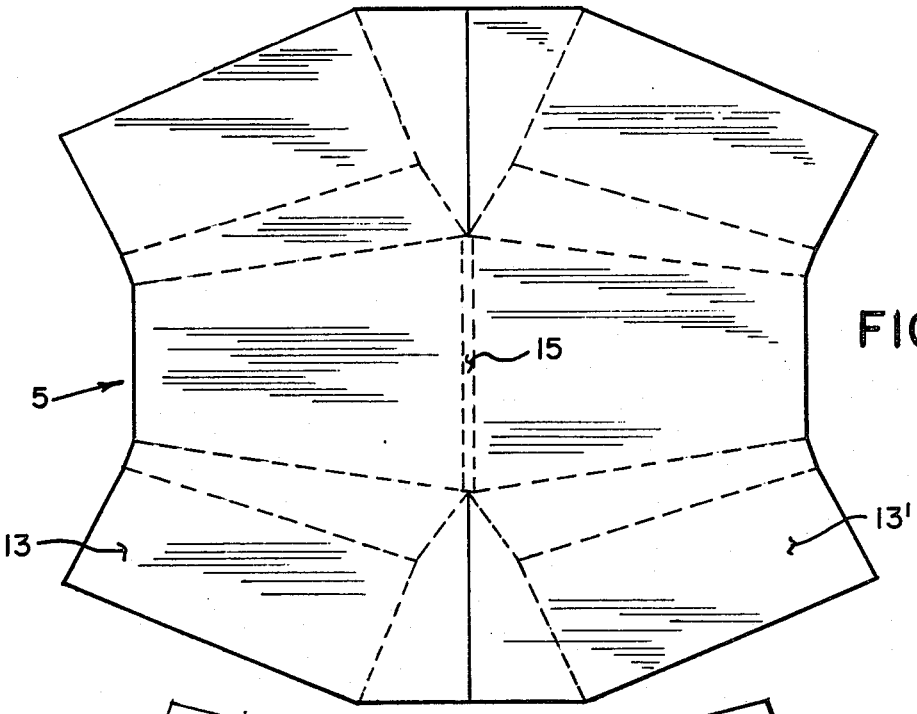

Each intermediate main body 5 is comprised of a pair of substantially identical legs 13, 13' folded in back-to-back relation interconnected at their bottoms as indicated at 15, (see FIG. 13). Each leg is of hollow construction and has a respective opening 17, 17' (see FIG. 11) extending therethrough, this opening being open both at the top and bottoms of each respective leg. A flat pattern piece of corrugated paperboard from which an intermediate main body module may be formed is shown in FIG. 4.

Figure 5:
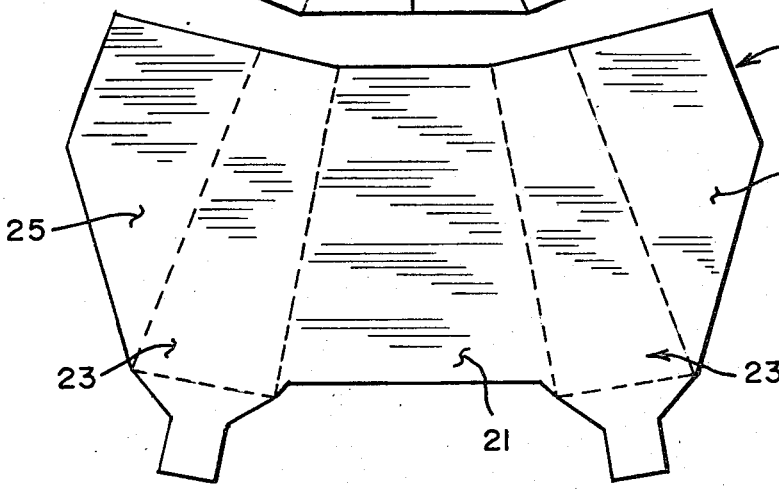

A so-called side connector module 19 (see FIG. 10) has a main body panel 21 (see FIG. 5) which fits between the legs of one of the main body modules and has side panels 23 which fit over the sides of the legs of one of the main body modules and over the sides of the legs of the next adjacent main body module. Further, each of the side connector modules has end panels 25 which are folded together between the legs of the next adjacent main body module thereby to interconnect one main body module to the next adjacent main body module. A flat pattern of the piece of paperboard from which side connector module 21 may be formed is depicted in FIG. 5.

Figure 6:
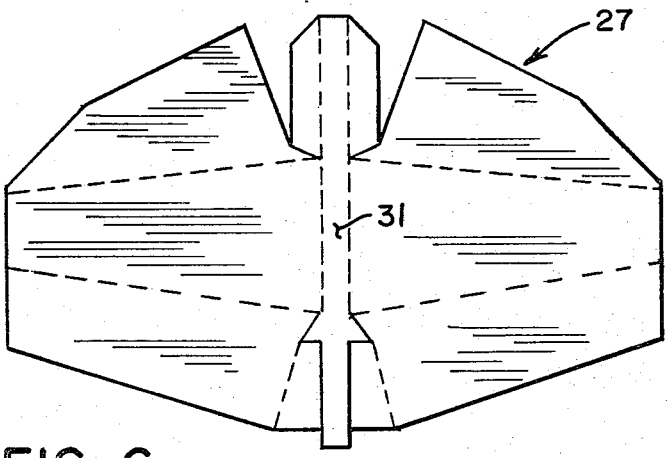

As generally indicated at 27, U-shaped top connector modules each having a pair of side-by-side legs 29, 29' and a web 31 interconnecting its legs are inserted into the top of the legs of adjacent main body modules. As shown, five top connector modules are utilized in the toy herein disclosed. The first connector module 27 at each end of the toy has its leg 29 fitted into opening 11 of the end main body module 3 and has its other leg 29' fitted into opening 17' of the next adjacent intermediate main body module thereby to interconnect the tops of the one end and next adjacent main body modules together. Another top connector module 27 has its legs inserted into opening 17 and 17' of the above-noted next adjacent intermediate main body module thereby to interconnect the tops of legs 13 and 13' of this next intermediate main body module. The remainder of the top connector modules are likewise inserted into corresponding adjacent openings 17, 17' or 11 of the remaining main body modules thereby to interconnect the tops of the main body modules together. A flat pattern layout of the piece of corrugated paperboard forming top connector module 27 is illustrated in FIG. 6.

Figure 8:
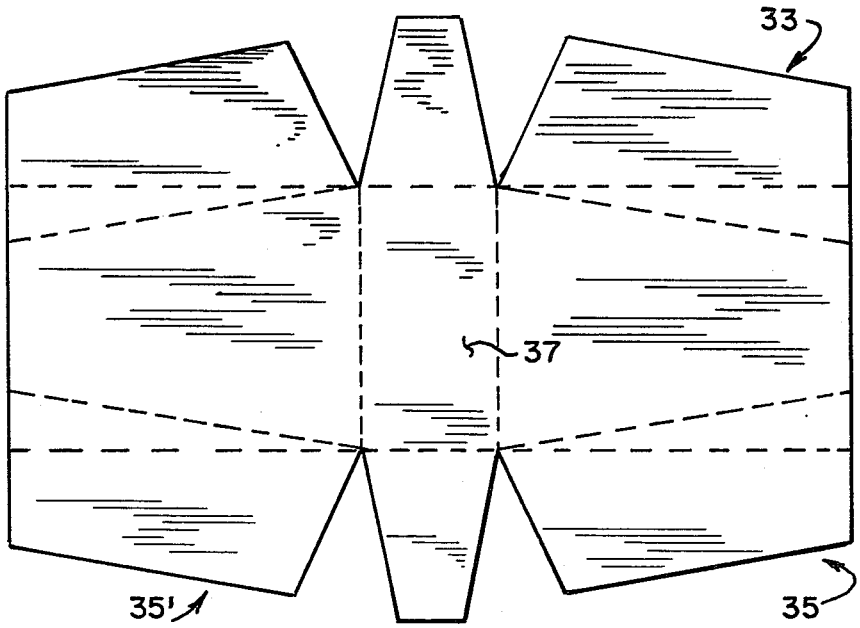
Figure 12:
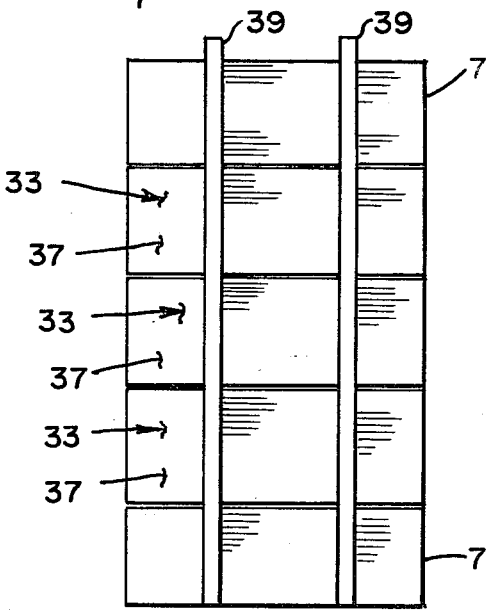
FIG. 12 is a bottom plan view of the toy.

A plurality of generally U-shaped bottom connector modules 33 each having back-to-back legs 35, 35' and a web 37 interconnecting its legs is inserted into openings 11, 13 and 13' of the main body modules 3 and 5 from below in a manner similar to the manner in which top connector modules 27, as described above, are inserted into the tops of the openings. Thus, the bottom connector modules interconnect the bottoms of the main body modules. It will be noted that webs 37 of the bottom connector modules are wider than webs 31 of the top connector modules and that these webs 37 form a generally curved rocking surface, as generally indicated at R (see FIGS. 1 and 11), on which rocking toy 1 may rock. A flat pattern for the unitary piece of paperboard from which bottom connecting module 33 may be formed is shown in FIG. 8. As shown in FIGS. 1, 10 and 12, optional curved, rigid rockers 39 of wood or the like may be fitted on the bottom of main body modules 3 and 5 so as to serve as rockers for toy 1. It will be appreciated, however that the toy of this invention may be so designed and constructed that the bottoms of the U-shaped bottom connectors 33 form a flat bottom surface for the toy rather than a rocking surface so that the resulting toy functions as a stable chair or the like.

Figure 9:
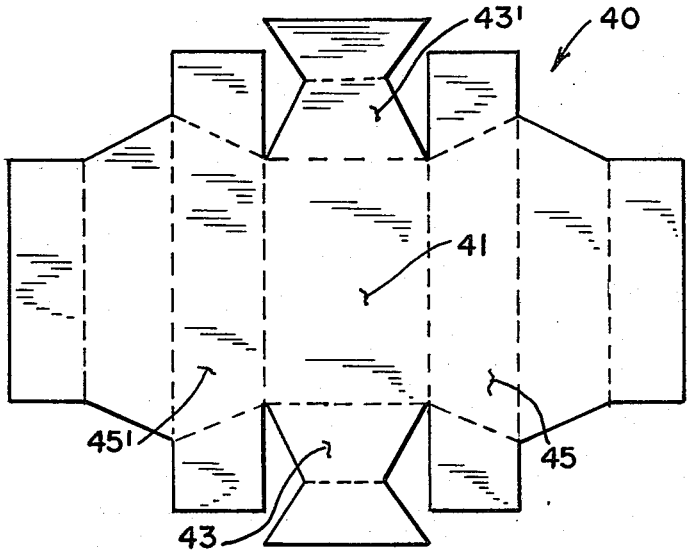

A seat for toy 1 is provided by a so-called cover module 40 fitted over the upper ends of main body modules 3 and 5 and over webs 31 of top connector modules 27. A flat pattern of the cover is shown in detail at FIG. 9. As shown, cover module 40 has a top or main panel 41 which also serves as a seat for the toy. The main panel has end panels 43, 43' which are adapted to be tucked down on the outer face of the outer leg 7 of the rear end main body module and between leg 13 of the intermediate body module 5 and leg 7' of the front main body module 3. Further, the cover module has side panels 45, 45' which extend down over the tops of side panels 23 of side connecting modules 19.

Figure 3:
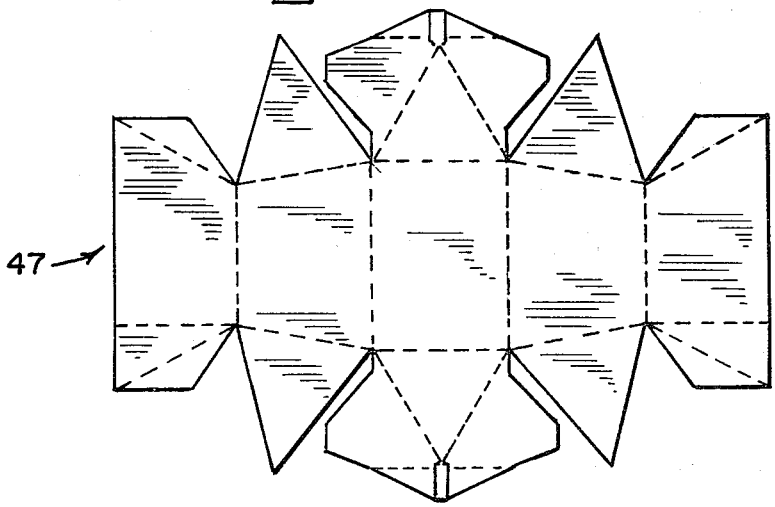
Figure 7:
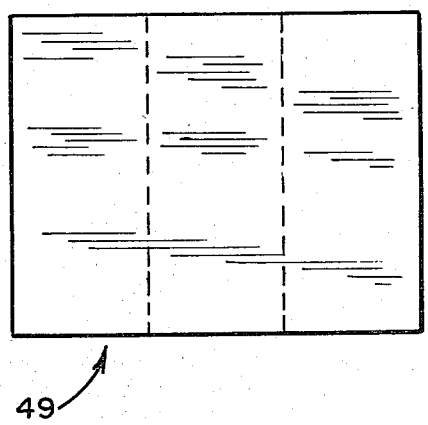

As generally indicated at 47 in FIGS. 1 and 10, a so-called head module is provided so as to resemble the head of a horse or the like when installed on the rocking toy. Head module 47 is formed from a flat panel, such as is shown in FIG. 3, and is attached to the main body modules by means of a tab 49 (see FIG. 7) inserted into opening 11 in leg 7' of an end main body module 3.

It will be understood that the various pieces or panels forming the various above-described modules may be readily fabricated from suitable corrugated paperboard stock or the like by die cutting or by other means with the foldlines being pre-scored on the piece. The appropriate number of the various panels are assembled in a kit and are shipped flat thus consuming considerably less volume than if the three-dimensional modules were assembled in the form of the rocking horse for shipment. Upon the kit being delivered to a customer, the customer then may readily assemble the rocking horse in a manner similar to that heretofore described by folding the individual sheets of paperboard along their indicated foldlines so as to form three-dimensional modules and by interconnecting the modules as above-described with the top, bottom and side connecting modules.

In accordance with this invention, by providing a plurality of three-dimensional modules formed of corrugated paperboard or the like, the modules have considerable compression and bending strength and are thus readily capable of supporting the weight of a child or other rider and of being ridden without buckling or otherwise damaging the paperboard sheets. By securely interconnecting the modules, a sturdy and rigid toy results.

In view of the above, it will be seen that the several objects and features of this invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. A toy comprising a plurality of three-dimensional modules interconnected together, each of said modules being formed by folding flat, substantially rigid sheet-like material along prescored lines, said toy including a plurality of main body modules including a pair of end body modules and at least one intermediate body module between the end body modules, each of said body modules having a pair of generally tubular legs arranged in back-to-back relation with the innermost leg of said end body modules having an opening therethrough and with each of the legs of said intermediate body modules having a respective opening therethrough, a plurality of generally U-shaped top connecting modules each having a pair of legs, said legs of said top connecting modules being insertable into adjacent openings of adjacent body modules, a plurality of bottom connecting modules each having a pair of legs and a web interconnecting the legs, said legs of said bottom connecting modules being insertable into adjacent respective openings of adjacent body modules, and a plurality of side connecting modules each having a main panel insertable between the legs of one of the body modules, said side connecting modules each having side panels overlying the side of the leg of said one body module and of an adjacent leg of a next adjacent body module, and each side panel having a pair of end panels receivable between the legs of said next adjacent body module, said webs of said bottom connecting members forming a bottom surface, said modules when so assembled being securely interlocked with one another so as to form a substantially rigid toy capable of supporting a child sitting on the tops of said body modules to simulate riding.

2. A toy as set forth in claim 1 wherein the adjacent webs of said bottom connectors form an overall generally curved surface so as to constitute a rocking surface.

3. A toy as set forth in claim 2 further comprising a pair of curved rails adapted to be secured to said rocking surface thereby to constitute rockers for said toy.

4. A toy as set forth in claim 1 further comprising a cover module adapted to fit over the upper ends of said legs of said body modules and the tops of said top connector members thereby to constitute a seat for the toy.

5. A toy as set forth in claim 1 further having a head module attachable to one of the end body modules.

6. A kit from which a rocking toy capable of being ridden by a child may be assembled, said kit comprising a plurality of pieces of substantially rigid sheet-like material, each of said pieces being pre-cut and being foldable along predetermined lines into three-dimensional modules, said modules being assembled to form a substantially rigid structure constituting said toy, said kit comprising a pair of end main body pieces adapted to form a pair of end body modules having a generally vertical opening therethrough, one or more intermediate body pieces adapted to form one or more intermediate body modules, the latter having two openings extending therethrough, said end and intermediate body modules being assembled in face-to-face abutting relation, a plurality of top pieces each of which is foldable to form a top connector module insertable from the top into adjacent openings of adjacent said body modules, a plurality of bottom pieces which are foldable to form bottom connector modules each of which is insertable into adjacent openings of adjacent said body modules from the bottom, a plurality of side pieces foldable to form side connector modules, the latter each having a main panel adapted to be disposed between adjacent portions of a main body module, side panels adapted to be disposed on the outside of portions of two adjacent main body modules, and end panels adapted to be disposed between portions of the next adjacent body module, whereby said side connector modules substantially surround portions of two adjacent body modules, and a top cover sheet adapted to form a top cover module for overlying the tops of said body modules and for constituting a seat for said toy.

* * * * *